US006414642B2

(12) United States Patent
Honda et al.

(10) Patent No.: US 6,414,642 B2
(45) Date of Patent: Jul. 2, 2002

(54) ORTHOGONAL SLOT ANTENNA ASSEMBLY

(75) Inventors: Royden Honda, San Jose; Robert Hill, Salinas, both of CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/738,588

(22) Filed: Dec. 15, 2000

Related U.S. Application Data

(60) Provisional application No. 60/184,603, filed on Feb. 24, 2000, and provisional application No. 60/172,513, filed on Dec. 17, 1999.

(51) Int. Cl.[7] ..... H01Q 1/24
(52) U.S. Cl. ..... 343/702; 343/767; 343/770
(58) Field of Search ..... 343/700 MS, 702, 343/767, 770, 829, 846, 848; H01Q 1/24

(56) References Cited

U.S. PATENT DOCUMENTS 3,662,392 A * 5/1972 Stapleton et al. ..... 343/708
3,969,730 A * 7/1976 Fuchser ..... 343/770
4,006,481 A 2/1977 Young et al. ..... 343/770
5,467,098 A * 11/1995 Bonebright ..... 343/767
5,784,032 A 7/1998 Johnston et al. ..... 343/702
5,845,391 A * 12/1998 Bellus et al. ..... 29/600
5,850,198 A * 12/1998 Lindenmeier et al. ..... 343/713
6,031,503 A 2/2000 Preiss, II ..... 343/770
6,052,093 A * 4/2000 Yao et al. ..... 343/770
6,147,647 A 11/2000 Tassoudji et al. ..... 343/700

OTHER PUBLICATIONS

International Search Report—PCT/US00/34038.

* cited by examiner

*Primary Examiner*—Tho Phan
(74) *Attorney, Agent, or Firm*—Fulbright & Jaworski L.L.P.

(57) ABSTRACT

The invention discloses a slot antenna having a pair of orthogonally oriented front and rear reflector panels. In one embodiment, the antenna assembly includes first and second front panels oriented approximately orthogonally to each other, said first and second front panels being coupled together and having a substantially elongate slot defined upon at least a portion of each of the first and second front panels, and first and second rear reflector panels oriented approximately orthogonally to each other, and disposed proximate the first and second front panels, and a feed terminal coupled to one of the first or second front panels, said feed terminal being coupled to an input/output RF connection point. The slot antenna according to the present invention may be disposed within an associated wireless communications device relative to a ground plane element of a printed wiring board, or may be disposed separately away from the associated wireless communications device.

28 Claims, 9 Drawing Sheets

ORTHOGONAL SLOT ANTENNA ASSEMBLY

This utility application claims the benefit of priority from U.S. Provisional Application Ser. No. 60/172,513, filed Dec. 17, 1999, and U.S. Provisional Application Ser. No. 60/184,603, filed Feb. 24, 2000.

FIELD OF THE INVENTION

The present invention relates generally to antenna assemblies for wireless communication devices and systems, and in particular to slot antenna assemblies. The invention provides particular utility to slot antennas for use in laptop computers, telecommunications devices, or other wireless devices, and in wireless local area network systems.

BACKGROUND OF THE INVENTION

There is a growing need for a structurally compact, resonant antenna assembly for efficient operation over a variety of frequency ranges including, for example, the wireless LAN frequencies. A further need exists for such an antenna to be suitable for mounting within a communication device and yet have little or no operational interference from other internal components of the device. In addition, there is a need for such antennas to have robust hemispherical coverage while minimizing external interference.

Existing antenna structures for wireless devices include both external and internal structures. External single or multi-band wire dipole antennas are half wave antennas operating over one or more frequency ranges. The typical gain is +2 dBi. These antennas have no front to back ratio and therefore radiate equally toward and away from the user of the wireless device without Specific Absorption Rate (SAR) reduction. LC (inductor and capacitor) traps may be used to achieve multi-band resonances. The bandwidth near the head is limited to 80 degrees nominal.

Another external antenna structure is a single or multi-band asymmetric wire dipole. This antenna is a quarter wave antenna operating over one or more frequency ranges. The typical gain is +2 dBi. There is no front to back ratio or SAR reduction. LC traps may be used to achieve multi-band resonances. An additional quarter wave conductor is needed to achieve additional resonances. The beamwidth near the head is limited to 80 degrees nominal.

Internal single or multi-band antennas include asymmetric dipole antennas. These antennas include quarter wave resonant conductor traces, which may be located on a planar, printed circuit board. These antennas operate over one or more frequency ranges with a typical gain of +1 to +2 dBi, and have a slight front to back ratio and reduced SAR. These antenna structures may have one or more feedpoints, and require a second conductor for a second band resonance.

Another internal antenna structure is a single or multi-band planar inverted F antenna, or PIFA. These are planar conductors that may be formed by metallized plastics. PIFA operate over a second conductor or a ground plane. The typical gain for such antennas is +1.5 dBi. The front to back ratio and SAR values are dependent of frequency.

SUMMARY OF THE INVENTION

An antenna assembly having first and second front panels generally vertically aligned in an orthogonal orientation to one another is described. The front panels include a slot which is continuous across the junction of the front and second panels, so the slot itself is also orthogonal. The orthogonal slot antenna assembly of the present invention is useful in laptop computers or other wireless devices benefiting from a compact and yet robust antenna which radiates with multiple polarizations in various multiple orientations. Additionally, the antenna assembly may be used with such devices with minimal operational interference.

The antenna assembly may also include the following properties: a size suitable for integration within a laptop computer unit, preferably at a front corner of the laptop unit; minimization of operational interference from a laptop docking station or other external sources by placement of the antenna in the preferred front corner of the laptop; minimization of operational interference from internal components of the laptop or other device by providing reflecting panels which may be electrically coupled to a device ground; robust hemispherical coverage achieved by the orthogonal orientation of the front panels and further enhanced by tilting the front panels relative to a horizontal plane; and enhanced performance at selected wireless LAN frequency ranges, preferably 2.4–2.5 GHz.

Another object of the invention is to provide an antenna integrated upon a transceiver board for ease and economy of manufacture. In one embodiment, an improved slot antenna assembly is provided for use with laptop computers, personal data devices, and other wireless communication devices. The antenna assembly is of a compact size suitable for mounting directly on the motherboard of a laptop computer. The orthogonal orientation of the front panels of the antenna optimizes the performance of the antenna within the laptop or other device. The antenna is preferably positioned at a front corner of the laptop computer or other device. The orientation and position of the antenna are designed to provide essentially equal performance with the laptop display open or closed, and to minimize interference from external sources, such as a docking station or a user's hands on the keyboard.

The orthogonal slot antenna assembly of the present invention also preferably includes reflecting panels between the front panels and other internal components of the laptop. These reflecting panels serve to minimize or eliminate operational interference from these internal components, further enhancing the antenna's performance.

Other objects and advantages will in part be obvious and will in part appear hereinafter, and will be accomplished by the present invention which provides an omni-directional slot antenna including a circuit board having a first dimension and a second dimension perpendicular to the first dimension. Electronic circuitry which receives and/or transmits RF signals is mounted to the circuit board. Typically, the electronic circuitry will also include an electronic circuit or network to match the impedance between the antenna and the receiving/transmitting circuitry. A first slot antenna arm is parallel to the first dimension and a second slot antenna arm parallel to the second dimension with one end of the first slot antenna arm connected or joined to the second slot antenna arm at a selected location so as to form, for example, a "L" shaped slot antenna.

The antenna has a three dimension, omni-directional pattern, able to communicate using vertical and horizontal polarization signals with reasonable gain. The antenna exhibits a three dimension omni directional pattern without using complex structures such as arrays or two slots in a cross pattern. For example, the L-slot antenna is built as two arms orthogonal to each other to direct the current flow path so as to form a three dimension omni-directional radiation pattern. The design requires only a single feed point connecting the transceiver to the antenna, thus greatly simplifying the structure and reducing the cost compared to arrays or cross slot antennas.

In one preferred embodiment, the slot antenna includes an elongate orthogonal aperture. The length and width dimensions of the slot (i.e., the slot perimeter length) determines the resonant frequency of the antenna. By changing the slot perimeter length, the resonant frequency of the antenna can be very accurately adjusted to the desired value.

In another preferred embodiment, the antenna assembly includes top horizontal panels connected to the front panels. These top panels further assist in tuning the antenna to a predetermined resonant frequency.

In another embodiment, the antenna assembly may be disposed away from the ground plane of an associated wireless communications device and coupled via a signal transmission line such as an RF coax line, a microstrip transmission line, a coplanar wave guide, or other known signal transmission approaches as appreciated by those skilled in the arts.

In another embodiment, the antenna assembly of the present invention is further reduced in size by providing a meander slot upon the front panels. By doing so, the overall size of the antenna assembly can be reduced. An additional preferred embodiment includes a second slot in addition to the meander slot in the front panels. The second slot allows shifting of the frequency band for frequency band adjustment.

DETAILED DESCRIPTION OF THE PREFERRED EMBODIMENTS

Figure 1:
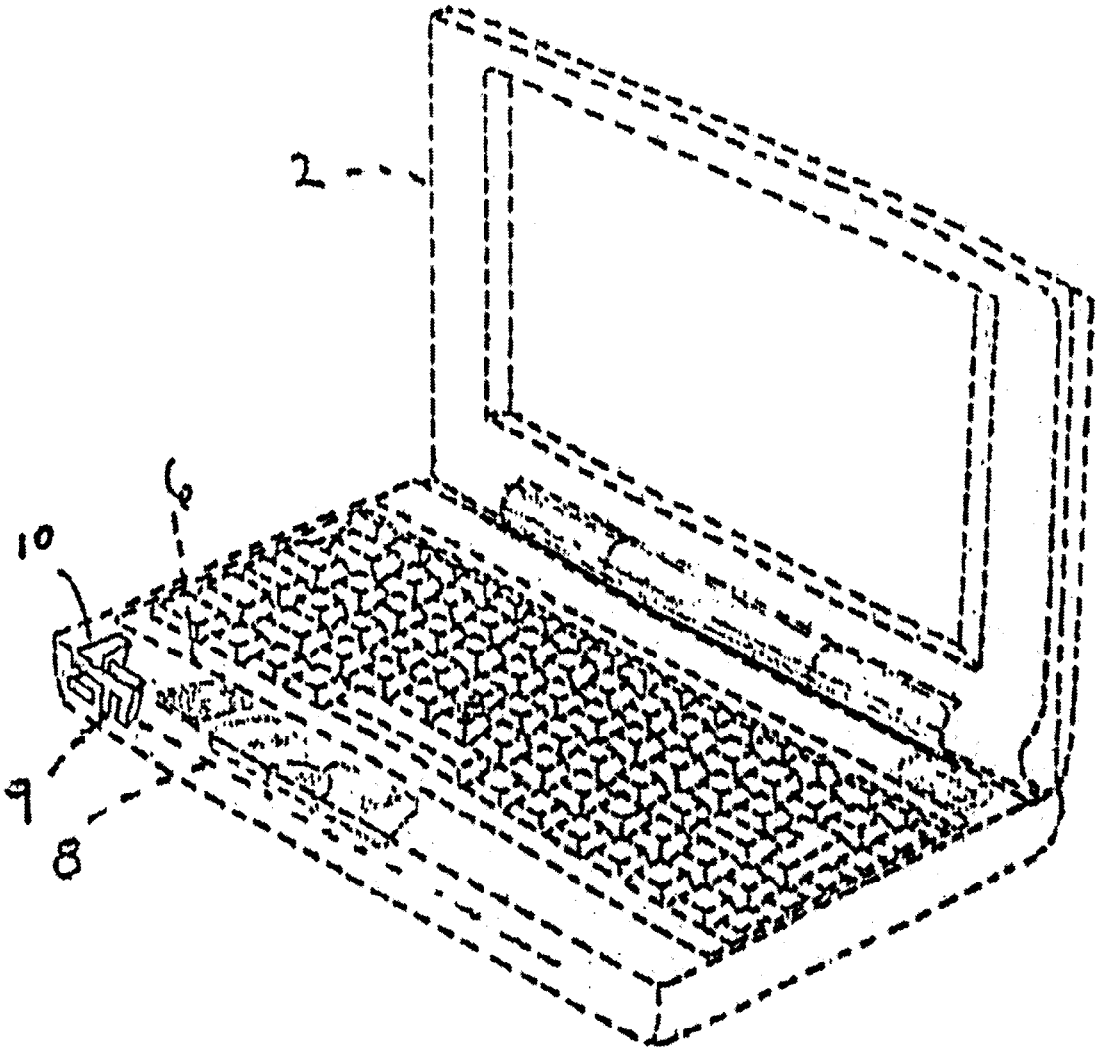
FIG. 1 is a perspective view of a wireless communications device incorporating an antenna assembly according to the present invention.

Referring now to the drawings, wherein in like numerals depict like elements throughout, FIG. 1 illustrates a wireless communications device, such as a portable personal or laptop computer 2, having a printed wiring board 6 defining a circuit ground plane 8. Laptop computer 2 includes an antenna assembly 10 according to the present invention disposed thereupon and operatively coupled to the input/output RF connection 9 and the ground plane 8. Those skilled in the relevant arts will appreciate that utilization of the antenna assembly 10 according to the present invention may also be made with alternative wireless communications devices. The antenna assembly 10 is preferably positioned in a front corner location of the computer motherboard to achieve the desired omni-directional azimuth-plane performance. The antenna assembly 10 can be installed in either the front left corner or front right corner to achieve the desired performance. As further described herein, the antenna assembly 10 of the present invention preferably has tabs that can be soldered or otherwise directly attached to pads on the motherboard for RF and ground connections, eliminating the need for additional connectors.

Figure 2:
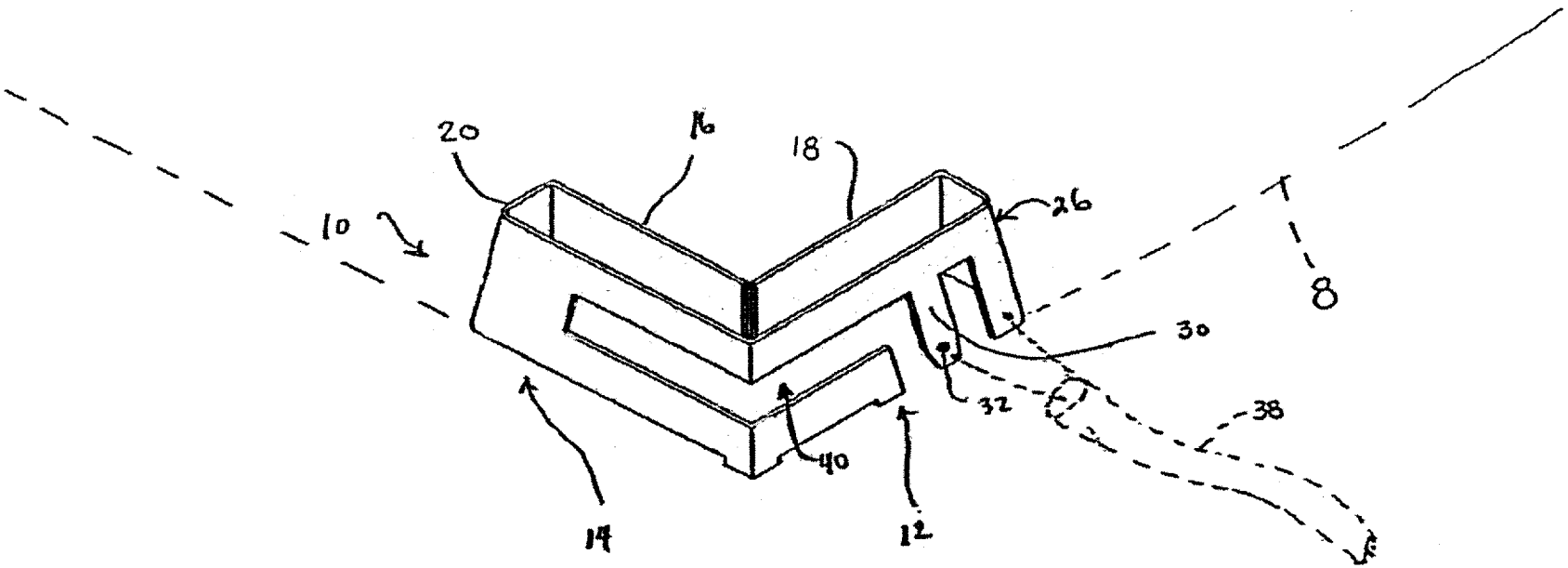
FIG. 2 is a detailed perspective view of one embodiment of an antenna assembly according to the present invention.
Figure 2A:
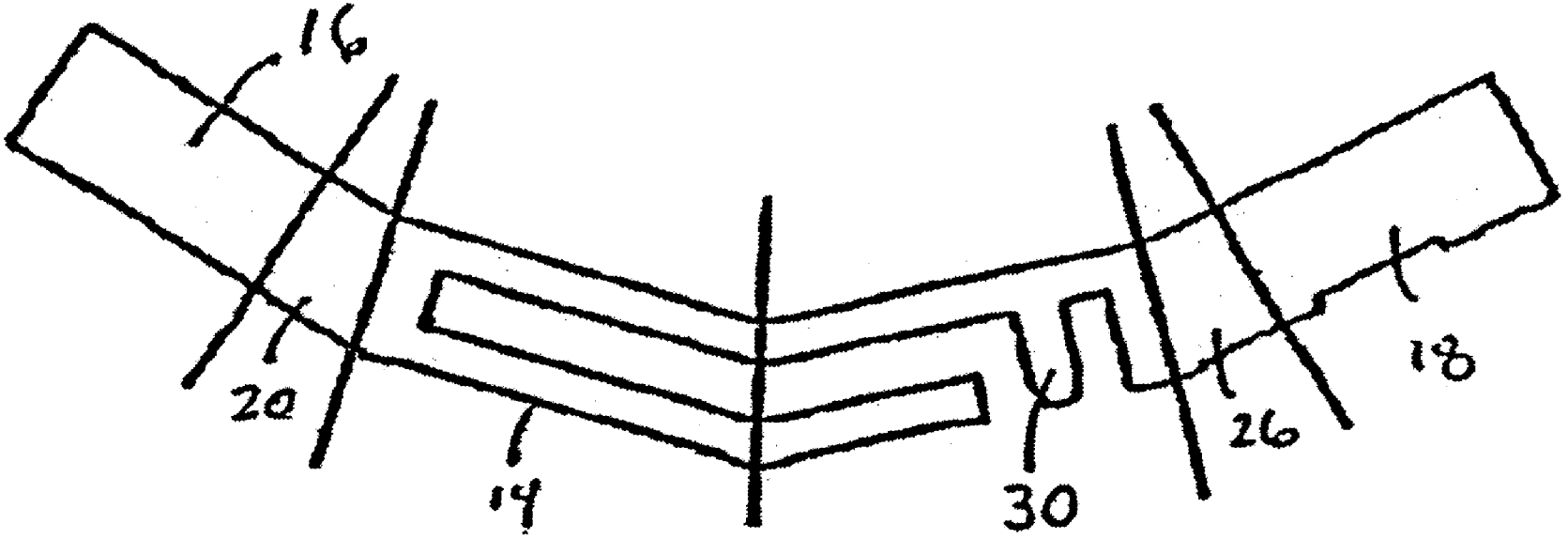
FIG. 2*a* is a top plan view of a portion of the antenna assembly of FIG. 1 shown in blank form prior assembly.

FIG. 2 illustrates one embodiment of the antenna assembly 10. The antenna 10 may be formed from a single sheet of conductive material, as shown in FIG. 2*a*. In one embodiment, the antenna 10 may be formed using known metal stamping and bending procedures. The antenna 10 includes front panels 12 and 14, back reflector panels 16 and 18, and side panels 20 and 26. Tab 30 defines the feed point for the antenna 10. Location 32 of tab 30 is the point at which antenna 10 is coupled to the RF port of the wireless device, such as a laptop computer unit 2, or other telecommunications device. The location of tab 30 relative to the top rung of front panel 12 determines the voltage standing wave ratio of the antenna 10. The length of slot 40 defined on front panels 12 and 14 determines the resonant frequency the antenna 10. The back reflectors 16 and 18 are electrically coupled to the device ground plane 8 and minimize the interaction of the antenna 10 with internal electronic components of the wireless device 2. The back reflectors 16, 18 and side panels 20,26 may each be coupled to the ground plane 8 along respective lower edges. Alternatively, the reflectors 16,18 and side panels 20, 26 may be intermittently coupled to the ground plane 8 along respective lower edges via one or more tab elements 48 (See, FIG. 5). The front panels 12 and 14 are approximately orthogonally oriented to each other and project at an angle from the ground plane 8, promoting better coverage over the upper hemisphere while providing a compact structure suitable for use in portable wireless devices. The rear reflector panels 16, 18 are approximately orthogally oriented to each other and project substantially perpendicular to the ground plane 8.

Still referring to FIG. 2, a second feed embodiment is illustrated in phantom lines as an RF coax signal line 38. In this second feed embodiment, a center conductor of the coax 38 is coupled to the antenna 10 at tab 30 and the shield conductor of the coax is coupled at the front panel 12. In this embodiment, the antenna 10 may be removed from the ground plane 8 of the wireless communications device 2, i.e., disposed separately away from the ground plane 8 of the associated wireless communications device 2.

Figure 2D:
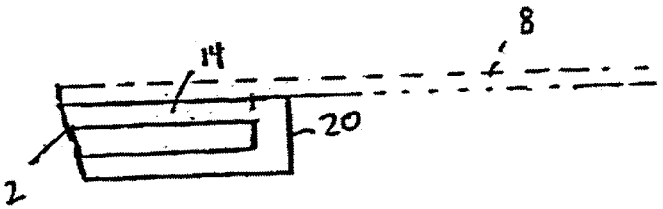
FIG. 2*d* is another side elevational view of the antenna shown in FIG. 1.
Figure 2B:
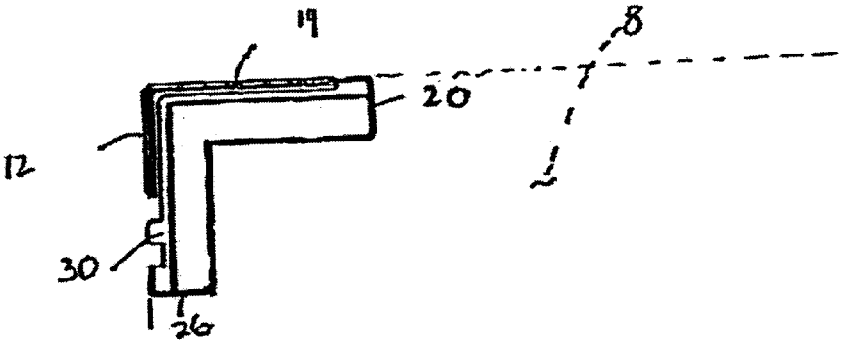
FIG. 2*b* is a top plan view of the antenna shown in FIG. 1.
Figure 2C:
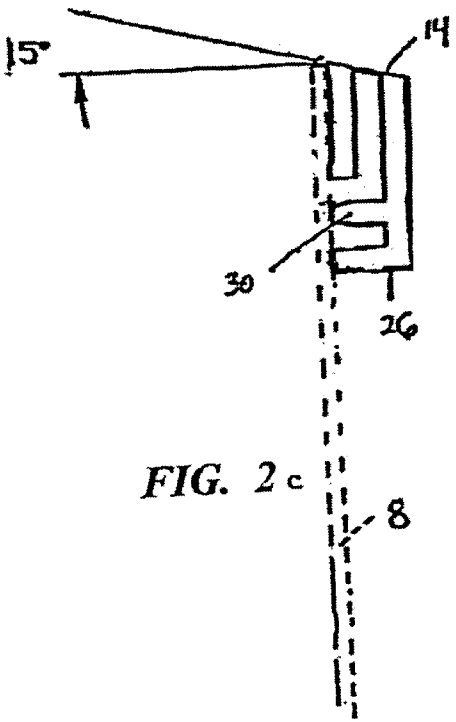
FIG. 2*c* is a side elevational view of the antenna shown in FIG. 1.

As seen in FIGS. 2*b–d,* front panels 12 and 14 of antenna 10 are preferably tilted relative to a plane perpendicular to the ground plane 8 at an angle of approximately 15 degrees. This front panel 12, 14 tilt provides the antenna 10 with better coverage in the upper hemisphere.

Figure 3:
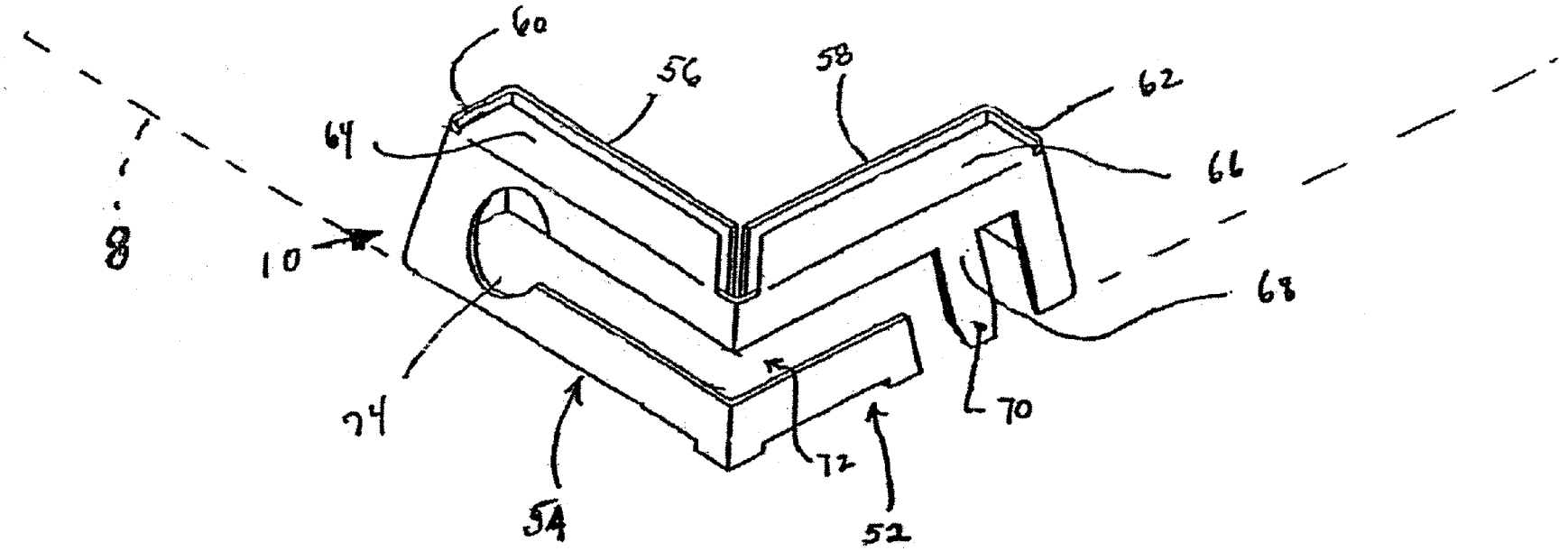
FIG. 3 is a perspective view of another embodiment of the antenna assembly of the present invention.

FIGS. 3 and 4 illustrate another embodiment of the antenna 10. The antenna 10 may be similarly formed from a single conductive sheet as shown in FIG. 4*a*. The antenna 10 includes front panels 52 and 54, rear reflector panels 56 and 58, side panels 60 and 62, and top horizontally aligned panels 64 and 66. Tab 68 defines the feedpoint of the antenna assembly 10. Location 70 of tab 68 is the point at which the antenna 10 is coupled to the RF port of the wireless device. The location of tab 68 relative to the top rung of front panel 52 determines the VSWR of the antenna 10. The length of slot 72 defined on front panels 52 and 54 and the diameter of aperture 74 at an opposed end of the slot 72 together determine the resonant frequency of the antenna. The rear reflectors 56 and 58 are coupled to device ground 8 to minimize undesirable interaction of the antenna 10 with internal components of the wireless device 2.

Figure 4A:
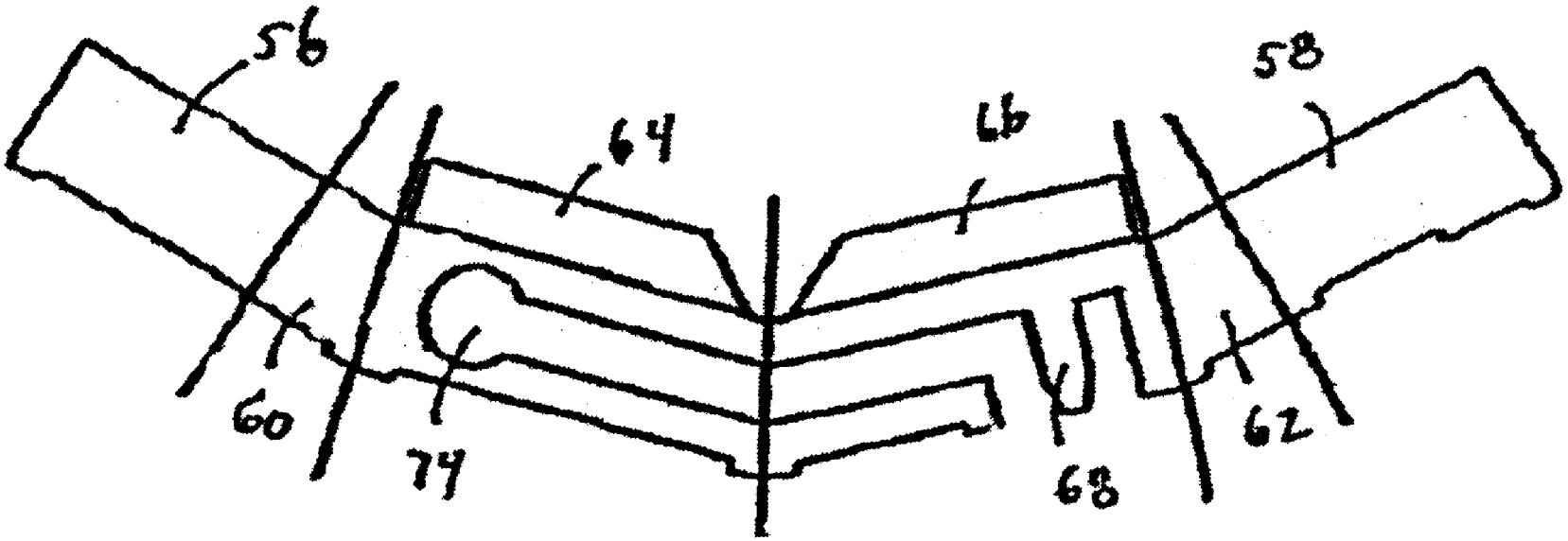
FIG. 4*a* is a top plan view of a portion of the antenna assembly of FIG. 3 shown in blank form prior assembly.
Figure 4D:
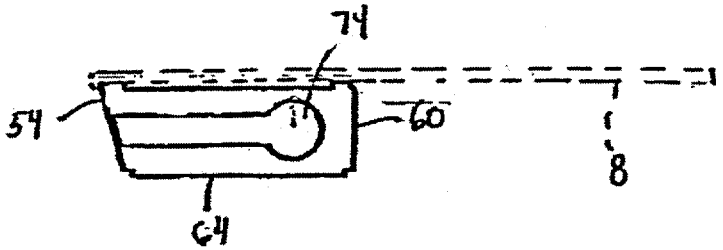
FIG. 4*d* is another side elevational view of the antenna shown in FIG. 3.
Figure 4B:
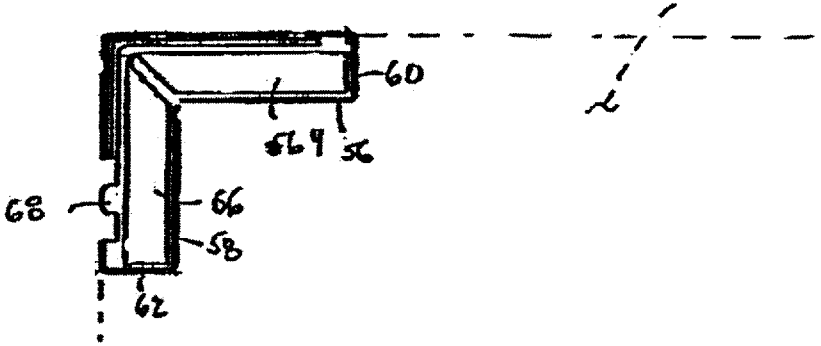
FIG. 4*b* is a top plan view of the antenna shown in FIG. 3.
Figure 4C:
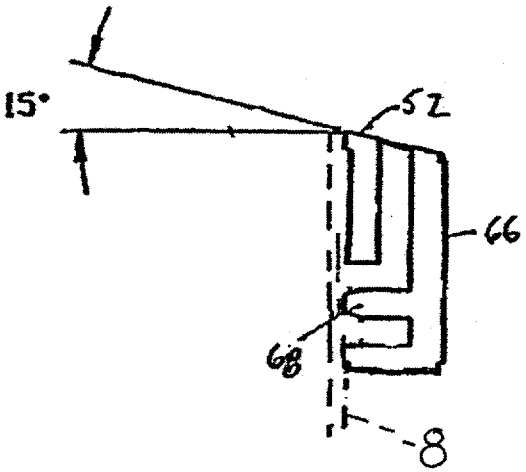
FIG. 4*c* is a side elevational view of the antenna shown in FIG. 3.

As illustrated in FIGS. 4*b–d,* the front panels 52 and 54 are oriented approximately orthogonally relative to each other and project at an angle from a ground plane 8, providing better operational coverage over the upper hemisphere. Front panels 52 and 54 are also tilted at a slight angle, preferably approximately 15 degrees relative to a plane perpendicular to the ground plane. This tilt of the front panels 52 and 54 promotes improved operational coverage of the antenna 2 in the upper hemisphere. Top panels 64 and 66 assist in tuning the antenna.

Figure 5:
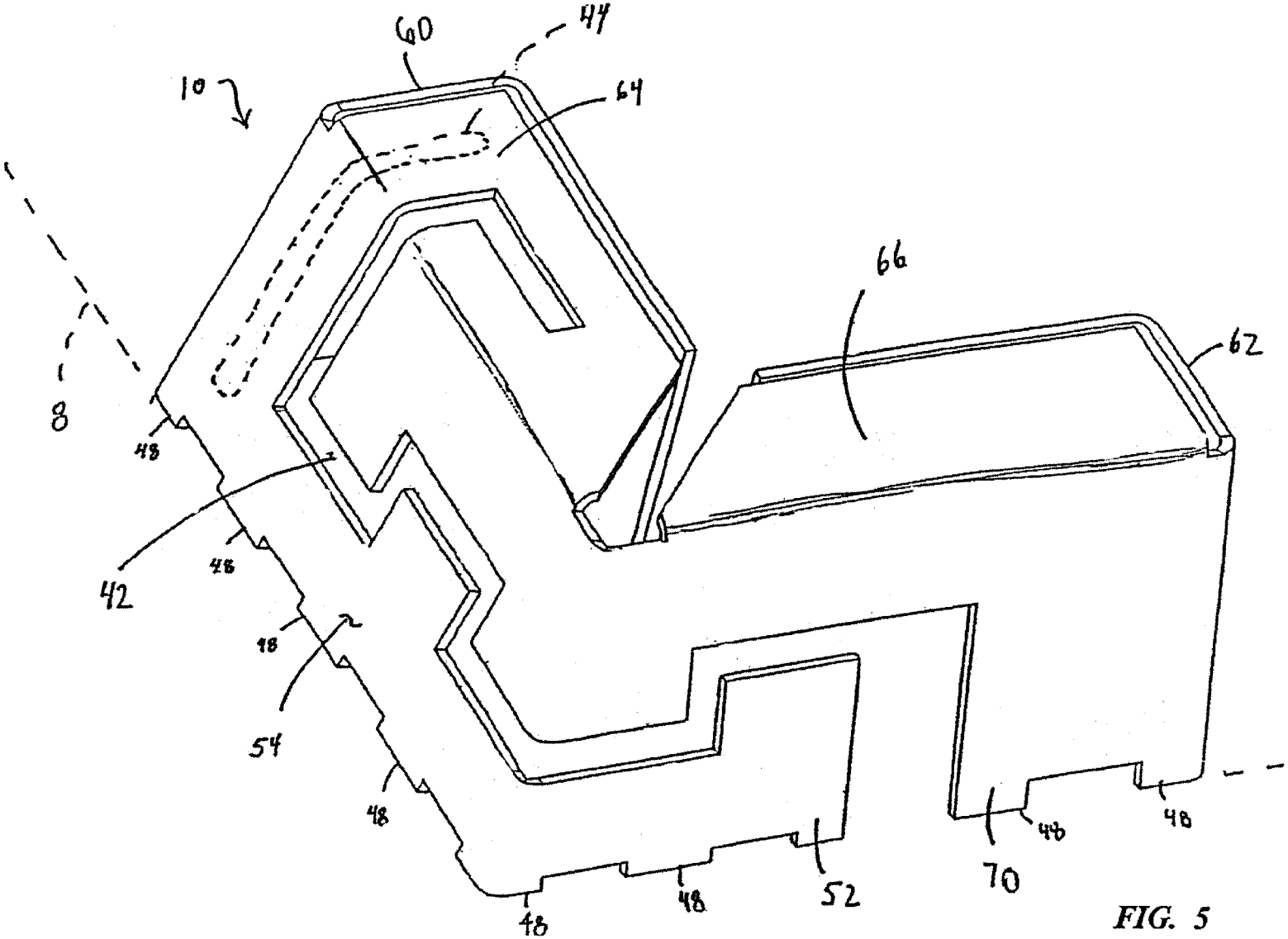
FIG. 5 is a perspective view of another embodiment of the antenna assembly of the present invention.

FIG. 5 illustrates another preferred embodiment of the invention. The antenna 10 is similar in construction to that shown in FIG. 3. The slot 42 of antenna 10 is a meander slot, which allows for the overall antenna size to be reduced with minimal decrease in pattern gain. The size of antenna 10 can be reduced by about 35% compared to those antenna assemblies shown in FIGS. 1–4. FIG. 5 also illustrates an optional second slot 44 in addition to the meander slot 42. The second slot 44 shifts the frequency band of the antenna. Although not shown, the antenna assemblies 10 of FIGS. 1 and 3 may also include a second slot 44.

Figure 6:
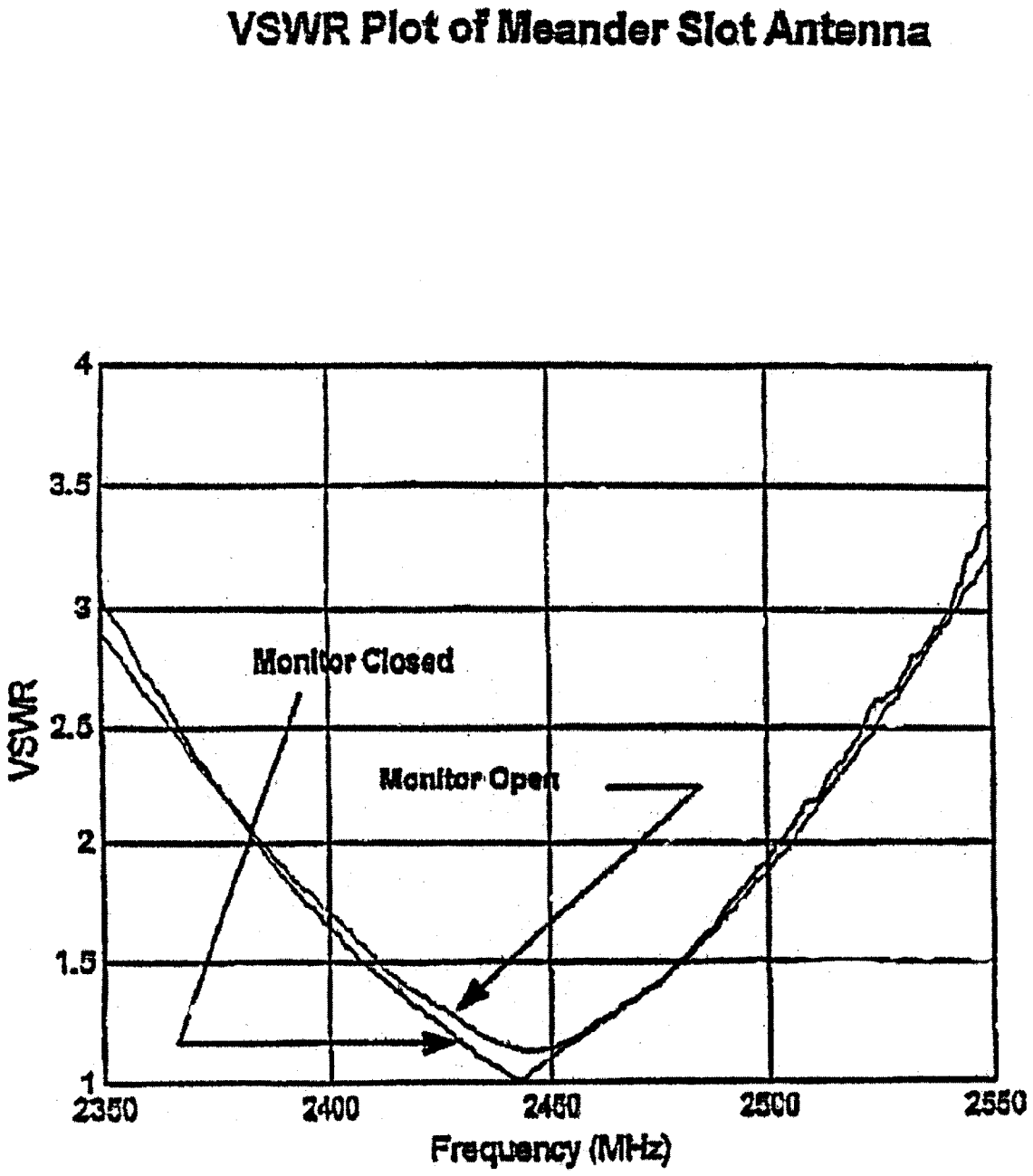
FIG. 6 illustrates test data for the embodiment of the antenna assembly of FIG. 5.

The orthogonal slot antenna assembly 10 of the present invention provides a robust and yet compact antenna 10 which can be integrated within a wireless device, such as a laptop computer 2. The antenna 10 has broad coverage and yet its performance is not significantly affected by other internal components of the wireless device or by external sources of interference. FIG. 6 provides VSWR and frequency data for an antenna assembly 10 of FIG. 5 incorporated within a laptop computer. FIG. 6 illustrates the relative difference between open and closed monitor orientations. Additional data relative to the antenna assembly 10 of the present invention is disclosed in U.S. Provisional Application Ser. No. 60/172,513, filed Dec. 17, 1999, and U.S. Provisional Application Ser. No. 60/184,603, filed Feb. 24, 2000, both provisional applications incorporated by reference in their entireties.

With knowledge of the present disclosure, other modifications will be apparent to those persons skilled in the art. Such modifications may involve other features which are already known in the design, manufacture and use of antennas and component parts thereof and which may be used instead of or in addition to features already described herein. Such modifications may include alternative manufacturing processes to form the various antenna panels, e.g., for example, conductive material selectively plated over dielectric substrate or dielectric materials, and plated plastic components and conductive foil elements. In exemplary alternatives, the reflector panels and/or side panels may be coupled to the shield element of a coaxial RF cable, a strip line feed, a ground portion of a coplanar wave guide, or other methods as known to those skilled in the relevant arts. Additionally, while the preferred embodiments have been described herein as applying to the wireless local area network frequencies, operation in alternative band widths may also be feasible. Those skilled in the relevant arts will appreciate the applicability of the orthogonal slot antenna assembly of the present invention to alternative bandwidths by proper scaling of the antenna components, etc. Still other changes may be made without departing from the spirit and scope of the present invention.

We claim:

1. An antenna assembly for a wireless communications device, comprising:

a circuit board element defining at least a ground plane and an input/output RF connection point;

first and second front panels oriented approximately orthogonally to each other, said first and second front panels being coupled together and having a substantially elongate slot defined upon at least a portion of each of the first and second front panels, said first and second front panels each being oriented at an angle relative to the ground plane;

first and second rear reflector panels oriented approximately orthogonally to each other, and disposed proximate the first and second front panels, said first and second rear panels being operatively coupled to the ground plane of the circuit board; and, a feed terminal coupled to one of the first or second front panels, said feed terminal being coupled to the input/output RF connection.

2. The antenna assembly of claim 1 wherein the first and second rear reflector panels are oriented substantially perpendicular to the ground plane.

3. The antenna assembly of claim 1, wherein the first and second front panels are each oriented at a similar angle of approximately 15 degrees away from perpendicular to the ground plane.

4. The antenna assembly of claim 1, wherein the first and second front panels are operatively coupled to the first and second rear reflector panels.

5. The antenna assembly of claim 4, further comprising:

a pair of side conductive panels for coupling the first and second front panels to the first and second rear reflector panels.

6. The antenna assembly of claim 1, further comprising first and second top panels adjacent to the first and second front panels, said top panels oriented approximately parallel to the ground plane.

7. The antenna assembly of claim 6, wherein the top panels extend towards the rear reflector panels.

8. The antenna assembly of claim 1, wherein the slot further comprises an aperture.

9. The antenna assembly of claim 8, wherein the aperture is positioned at an end of the slot opposing the feed terminal.

10. The antenna assembly of claim 1, wherein the slot includes a plurality of disjointed linear portions.

11. The antenna assembly of claim 1, wherein the first and second front panels are conductive metal elements.

12. The antenna assembly of claim 1, wherein the first and second front panels are conductive foil elements.

13. The antenna assembly of claim 1, wherein the first and second front panels are conductive plated elements on a substrate element.

14. An antenna element for a wireless communications device having a circuit board element defining an input/output RF connection point and a ground connection point, said antenna element comprising:

first and second front panels oriented approximately orthogonally to each other, said first and second front panels being coupled together and having a substantially elongate slot defined upon at least a portion of each of the first and second front panels, said first and second front panels each being oriented at an angle relative to a ground plane of the wireless communications device;

first and second rear reflector panels oriented approximately orthogonally to each other, and disposed proximate the first and second front panels, said first and second rear reflector panels being operatively coupled to the ground connection point; and, a feed terminal operatively coupled to the elongate slot, said feed terminal being operatively coupled to the input/output RF connection point.

15. The antenna element of claim 14 wherein the first and second rear reflector panels are oriented substantially perpendicular to a ground plane of the wireless communications device.

16. The antenna element of claim 15, further comprising first and second top panels adjacent to the first and second front panels, said top panels oriented approximately parallel to the ground plane.

17. The antenna element of claim 16, wherein the top panels extend towards the rear reflector panels.

18. The antenna element of claim 14, wherein the first and second front panels are each oriented at a similar angle of approximately 15 degrees away from perpendicular to the ground plane.

19. The antenna element of claim 14, wherein the first and second front panels are operatively coupled to the first and second rear reflector panels.

20. The antenna element of claim 14, further comprising:

a pair of side conductive panels for coupling the first and second front panels to the first and second rear reflector panels.

21. The antenna element of claim 14, wherein the slot further comprises an aperture.

22. The antenna element of claim 21, wherein the aperture is positioned at an end of the slot opposing the feed terminal.

23. The antenna element of claim 14, wherein the slot includes a plurality of disjointed linear portions.

24. The antenna element of claim 14, wherein the first and second front panels are conductive metal elements or conductive foil elements.

25. The antenna element of claim 14, wherein the first and second front panels are conductive plated elements on a substrate element.

26. The antenna element of claim 14, wherein the first and second front panel and first and second rear reflector panels are disposed within an interior of the wireless communications device relative to a ground plane defined upon a printed wiring board.

27. A combination slot antenna and electronic circuitry comprising:

a circuit board defining a ground plane and upon which at least a portion of the electronic circuitry is disposed, said circuit board having a first selected dimension and a second selected dimension substantially perpendicular to said first dimension;

a first conductive panel having a first slot defined thereupon, said first conductive panel being substantially parallel to said first dimension; and, a second conductive panel having a second slot defined thereupon, said second conductive panel being substantially parallel to said second dimension, one end of said first panel conductively joined to a selected location of said second panel such that said first slot is substantially perpendicular to said second slot, each of said first conductive panel and said second conductive panel being oriented at an angle relative to the ground plane.

28. A combination slot antenna and electronic circuitry of claim 27 further comprising:

a first and second conductive rear panels disposed relative to the first and second conductive panels.

* * * * *